US007472435B2

(12) United States Patent
Havens

(10) Patent No.: US 7,472,435 B2
(45) Date of Patent: Jan. 6, 2009

(54) P-TRAP DRAINAGE DEVICE

(76) Inventor: Brian David Havens, 10913 Larson Dr., Northglenn, CO (US) 80233

( * ) Notice: Subject to any disclaimer, the term of this patent is extended or adjusted under 35 U.S.C. 154(b) by 0 days.

(21) Appl. No.: 11/430,150

(22) Filed: May 7, 2006

(65) Prior Publication Data

US 2007/0056093 A1 Mar. 15, 2007

Related U.S. Application Data

(63) Continuation-in-part of application No. 10/605,316, filed on Sep. 14, 2005, now Pat. No. 7,131,150.

(51) Int. Cl.
*E03C 1/12* (2006.01)

(52) U.S. Cl. ..... 4/679; 4/288; 4/DIG. 14

(58) Field of Classification Search ..... 4/286–289, 4/292, DIG. 14, 652
See application file for complete search history.

(56) References Cited

U.S. PATENT DOCUMENTS 523,855 A * 7/1894 Frye ..... 137/625.31
2,068,406 A * 1/1937 Freed ..... 4/378
5,413,705 A * 5/1995 Tammera et al. ..... 210/94

FOREIGN PATENT DOCUMENTS

JP 10-118475 * 5/1998
WO WO2005/111326 * 11/2005

* cited by examiner

*Primary Examiner*—Huyen Le

(57) ABSTRACT

A P-trap drainage device having a tubular body and a plurality of internal angled vanes which direct water flow in a circular or whirlpool pattern has a short coupling portion having a coupling thereon, and an extension portion dimensioned and configured to fit within standard sizes of plumbing pipes. In use, the device causes vertically flowing water coming from the drain to the P-trap to "swirl", increasing the efficiency of flow. The shortness of the coupling portion allows easier use of the device in typically cramped conditions.

12 Claims, 10 Drawing Sheets

P-TRAP DRAINAGE DEVICE

CROSS-REFERENCE TO RELATED APPLICATIONS

The application is a continuation-in-part of copending U.S. patent application Ser. No. 10/605,316 filed Sep. 14, 2005 now U.S. Pat. No. 7,131,150 in the name of the same inventor, Brian Havens, and entitled A DEVICE TO ASSIST P-TRAP DRAINAGE, and claims the priority and benefit of that earlier application.

COPYRIGHT NOTICE

A portion of the disclosure of this patent document contains material which is subject to copyright protection. The copyright owner has no objection to the facsimile reproduction by anyone of the patent document or the patent disclosure, as it appears in the Patent and Trademark Office patent file or records, but otherwise reserves all copyright rights whatsoever. 37 CFR 1.71(d).

FIELD OF THE INVENTION

This invention relates generally to plumbing systems and specifically to bathroom, kitchen and utility sink drainage.

STATEMENT REGARDING FEDERALLY FUNDED RESEARCH

This invention was not made under contract with an agency of the US Government, nor by any agency of the US Government.

BACKGROUND OF THE INVENTION

Plumbing of a sanitary and hygienic sink or other fixture having a drain necessitates employing a trap, to act as a vapor barrier, against noxious or even unsanitary odors, vermin, bacteria and the like passing to an open drain hole in a sink, for example, and the conduit to a sewer system or septic holding tank. Even a kitchen sink requires such a trap. Such traps are configured so as to retain a small amount of water in a U-shaped bend, this water then acts to prevent any reflux of undesirable gases, particles and pests from entering into bathroom, kitchen, laundry room or other space through an otherwise open drain. The use of such traps has been known for hundreds of years, and more recently has become a matter of code or building regulations. Without the use of such traps, the typical drain to a sewer system would become an open pathway for foul odors and disease carrying pathogens.

The U or P bend is normally disposed underneath a fixture to be drained, whether that is a floor drain, a laundry drain, or a sink. The space under an exemplary bathroom or kitchen sink is very limited, however, which means that the system of piping must not take up excessive space. On a practical basis, just getting the various types of fixture drains to run to the trap and thence to the outlet from the space is hard enough without adding large or bulky additional devices to the system. Repair of such systems is an even greater challenge: old parts must be removed within the small space, parts which have rusted together must be separated, and so on. The P-trap has the benefits of being relatively small and easy to manufacture at low cost, and it would not be desirable to attempt to use large or expensive systems in conjunction with such P-traps.

The actual U-shaped bend may be called a U-bend or U-trap, and forms one portion of the larger P-trap. For use in this application, the term P-trap will be used, but the term should be understood to apply to the U portion and other terms for or types of vapor barrier traps. More specifically, a conventional trap is typically made using the U bend to which the plumber or builder attaches, a J bend at the outlet leg of the U, thus defining a generally horizontal outlet and making the signature "P" shape from the "U" and the straight outlet. The outlet of course is then be connected to conduits connected to the sewer or septic system for the disposal of liquid wastes.

Thus a conventional P-trap is formed from generally tubular drain fittings, which may be fabricated from either metal or plastic. For plastic fitting P-traps the inlet leg of the U is frictionally coupled in physical engagement using a nut and either a rubber gasket or beveled compression washer collar fitting so as to firmly grip a vertical drain pipe which extends down from the fixture to be drained. Typically the various joints of the system (for example between the J bend and the U bend) are joints which are detachable joints held together by a threaded connector.

It is worth noting at this point that assembly of the system depends on getting lengths of the various components correct. This would be relatively easy if part sizes and lengths were standardized to meet standard drain locations, standard sink and bath sizes and so on, but in reality, the installation process is made harder because all lengths of the pipes must meet to make a complete system which does not suffer from an excessive amount of tension, torsion or other stress or strain: such forces may eventually cause leaks or damage to parts. Thus, in addition to the need to avoid large or bulky additions to the system, it is desirable to avoid adding any elements which are of substantial length.

Such a P-trap may be installed as follows. First the drain pipe from the sink and the drain conduit connecting the sink to the septic or sewer system are roughed in to an approximate location. The ends of these pipes will be generally in the same area, but not attached. Then the P-trap is installed between the free ends of the two pipes. The P-trap, comprising the J-bend and the U bend are loosely threaded together, then the threaded joint can be adjusted for further manipulation of the pipes.

Turning to consideration of drainage of such P-traps, it will be understood that the P-trap dramatically alters the fluid flow within the system of pipes beneath the fixture drain. A straight vertical pipe has certain flow characteristics (fast flow or fall of water), a steeply angled pipe slightly different ones (ability to carry a substantial amount of matter), a flat pipe may have different flow patterns (no flow unless water is flowing into it at to provide pressure to cause flow to occur), an angled bend has other characteristics (a sharp flow disruption which may cause material to settle out) and so on. The complexity of flow within a P-trap may be understood if it is considered that the typical P-trap actually has a vertical drop, a curved section at various angles, a sharp elbow and a nearly horizontal run afterwards.

The natural result is well known to all homeowners. P-traps get clogged. The typical household has at least one individual who lets their hair or whiskers go down at least one drain, greasy materials may be put down the drain (for example, from washing of greasy hands), and without thinking, individuals continuously place obviously flow impeding materials into drains: all types of dirt, greases and oils of all types and so on. Eventually the P-trap clogs, the drained fixture becomes unusable and it becomes necessary to remove it or replace it at considerable expense and trouble. It is obviously desirable to make P-traps as difficult to clog as possible.

In addition, the typical P-trap flow disruption also alters the fluid flow within the pipe. For example, laminar fluid flow (in which the water flows in generally smooth or even layered patterns straight along the pipe) may give way to turbulent fluid flow (in which the water flows in less organized ways and with a greater degree of motion in three dimensions).

It would be advantageous to provide a device which alters the fluid flow within a trap so as to increase the efficiency of flow through the trap, in terms of flow rate, reduced chance of clogging or the like.

It would be advantageous to provide a device which is short in length in terms of the system of pipes of a P-trap drain, so as to allow easy installation in diverse plumbing traps despite the space and length limitations of such systems.

It would be advantageous to provide a device which is low in cost, easy to manufacture and easy to install in a typical P-trap drain.

SUMMARY OF THE INVENTION

General Summary

A P-trap drainage device having a tubular body and a plurality of internal angled vanes which direct water flow in a circular or whirlpool pattern has a short coupling portion or vestibule having a coupling thereon, and an insertion portion dimensioned and configured to fit within standard plumbing system pipes. In use the insertion portion is inserted into the open upper end of the P-trap and the coupling portion is attached to the vertical run of pipe from the sink drain.

Water flowing through the device will be urged to rotate in the device, so as to impart a different flow pattern on the flow through the P-trap and into the weir, increasing the efficiency of flow of the P-trap. A second coupling may be provided at the lower end: couplings may advantageously be standard ring connector nut trapped on the device or plumbing, a gasket or washer, or may be the matching exterior threading which the ring connector nut physically engages to.

The device may advantageously have four vanes which grow thicker as the vanes progress down the device, and the vanes may start with a gentle curvature but progress to a straight section, or vice-versa or other shapes. An axial support may be provided or omitted in alternative embodiments.

The device may be a molded unibody construction of PVC material or other durable polymer, or it may be metal.

The device, in preferred embodiments, may be constructed to standard plumbing internal and external diameters.

Summary in Reference to Claims

It is therefore a first aspect, advantage, objective and embodiment of the invention to provide a plumbing device for use in a plumbing system having standard plumbing couplers and having plumbing pipes having a plumbing outer diameter and a plumbing inner diameter, the plumbing device comprising:

a tubular body having an interior, an interior surface, an exterior and an exterior surface, and having a first open end and a second open end connected by the passage, and having an axis;

the tubular body having a coupling section having a standard plumbing coupling thereon, the coupling section having an inner diameter approximately equal to such plumbing outer diameter;

the tubular body having an insertion section having an outer diameter approximately equal to such plumbing inner diameter, whereby the tubular body insertion section may be at least partially inserted into such plumbing pipes; and at least one vane in the interior of the tubular body, the vane set at an angle to the axis of the plumbing device, whereby water passing through the plumbing device is urged to rotate as it passes down the length of the interior of the plumbing device.

It is therefore another aspect, advantage, objective and embodiment of the invention to provide a plumbing device wherein the standard plumbing coupling further comprises:

external threads located on the exterior of the tubular body at one end.

It is therefore another aspect, advantage, objective and embodiment of the invention to provide a plumbing device further comprising:

a second coupler disposed at the insertion section of the device.

It is therefore another aspect, advantage, objective and embodiment of the invention to provide a plumbing device further comprising:

at least a second vane in the interior of the tubular body, the vane set at an angle to the axis of the plumbing device.

It is therefore another aspect, advantage, objective and embodiment of the invention to provide a plumbing device wherein the first and second vanes further comprise:

a vane first end, a vane second end, and a vane thickness, the vane thickness varying from the vane first end to the vane second end.

It is therefore another aspect, advantage, objective and embodiment of the invention to provide a plumbing device wherein the variation of the vane thickness from the vane first end to the vane second end further comprises:

gradually increasing thickness from the vane first end to the vane second end.

It is therefore another aspect, advantage, objective and embodiment of the invention to provide a plumbing device further comprising:

a vane cross section perpendicular to the axis of the tubular body, the vane cross section varying from the vane first end to the vane second end.

It is therefore yet another aspect, advantage, objective and embodiment of the invention to provide a plumbing device wherein the variation in the vane cross section from the vane first end to the vane second end further comprises:

a curved cross section at the vane first end and a straight cross section a the vane second end.

It is therefore yet another aspect, advantage, objective and embodiment of the invention to provide a plumbing device further comprising:

a molded unibody construction of polyvinylchloride material.

It is therefore yet another aspect, advantage, objective and embodiment of the invention to provide a plumbing device wherein the tubular body further comprises:

a polymer pipe.

It is therefore yet another aspect, advantage, objective and embodiment of the invention to provide a plumbing device wherein the tubular body further comprises:

a metal pipe.

It is therefore another aspect, advantage, objective and embodiment of the invention to provide a plumbing device wherein the coupling section inner diameter further comprises:

a diameter approximately equal to the outer diameter of a standard plumbing drain pipe.

It is therefore another aspect, advantage, objective and embodiment of the invention to provide a plumbing device wherein the insertion section outer diameter further comprises:

a diameter approximately equal to the outer diameter of a standard plumbing drain pipe.

INDEX TO THE REFERENCE NUMERALS

| | |
|---|---|
| Fixture cylinder | 10 |
| Top rail | 11 |
| Bottom rail | 12 |
| Side bar | 13 |
| Vertical pipe | 14 |
| Nut | 16 |
| First vane | 21 |
| Second vane | 22 |
| Third vane | 23 |
| Fourth vane | 24 |
| U-bend | 25 |
| Water | 26 |
| J-bend | 28 |
| Tubular body | 100 |
| Interior | 102 |
| Interior surface | 104 |
| Exterior | 106 |
| Exterior surface | 108 |
| First open end | 110 |
| Second open end | 112 |
| Passage | 114 |
| Open axial space | 116 |
| Vestibule/coupling section | 118 |
| Threaded collar | 120 |
| Insertion section | 122 |
| First vane | 124 |
| Coupling | 126 |
| Beveled washer | 128 |
| Second vane | 130 |
| Vane first end | 132 |
| Vane second end | 134 |
| First vane thickness | 136 |
| Second vane thickness | 138 |
| First step | 140 |
| Second step | 142 |
| Fixture | 210 |
| Fixture drain | 212 |
| Substantially horizontal run to outlet | 230 |

DETAILED DESCRIPTION

Figure 1:
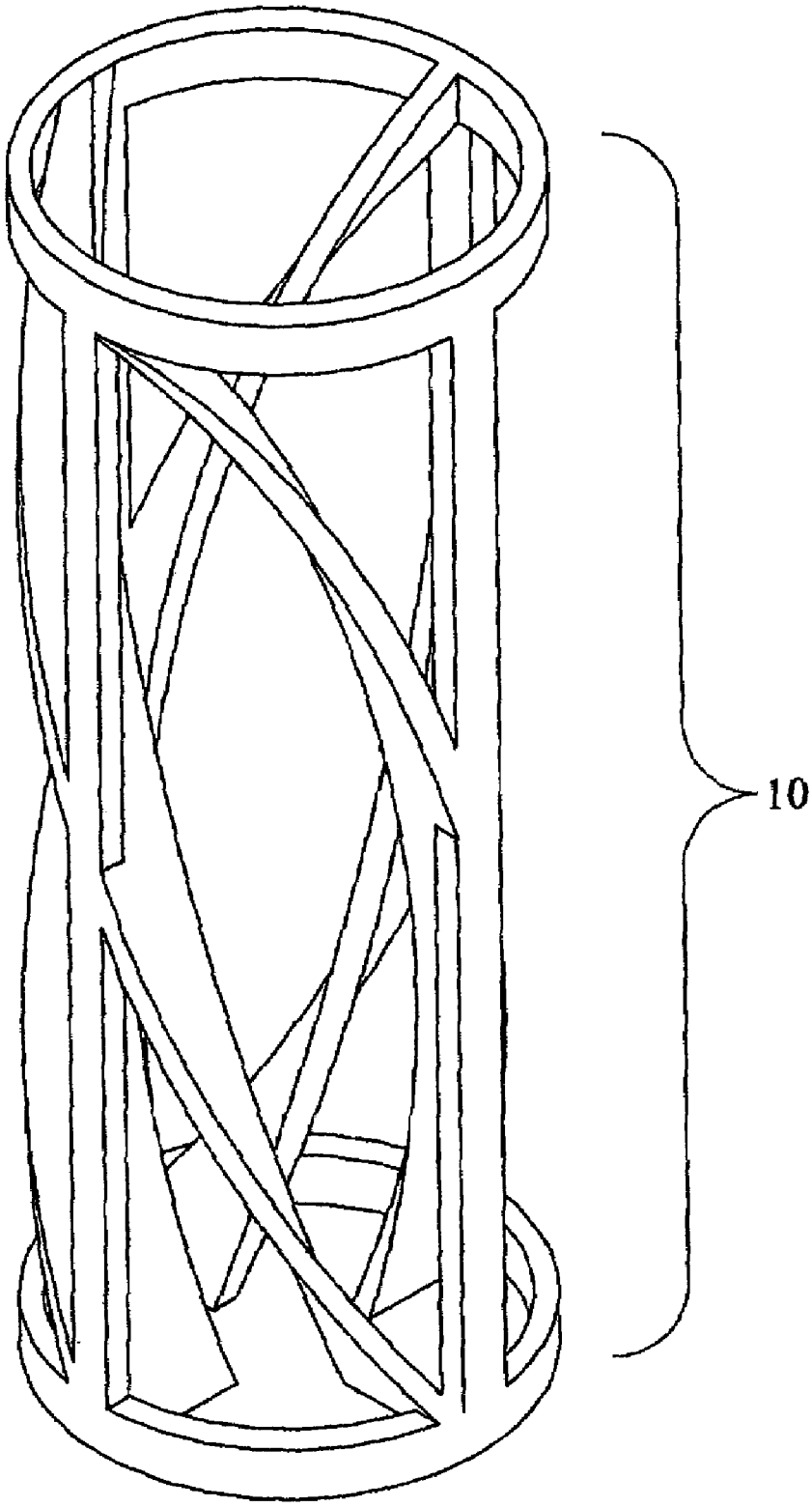
FIG. 1 is a side isometric view of an alternative embodiment of the device having no side.
Figure 2:
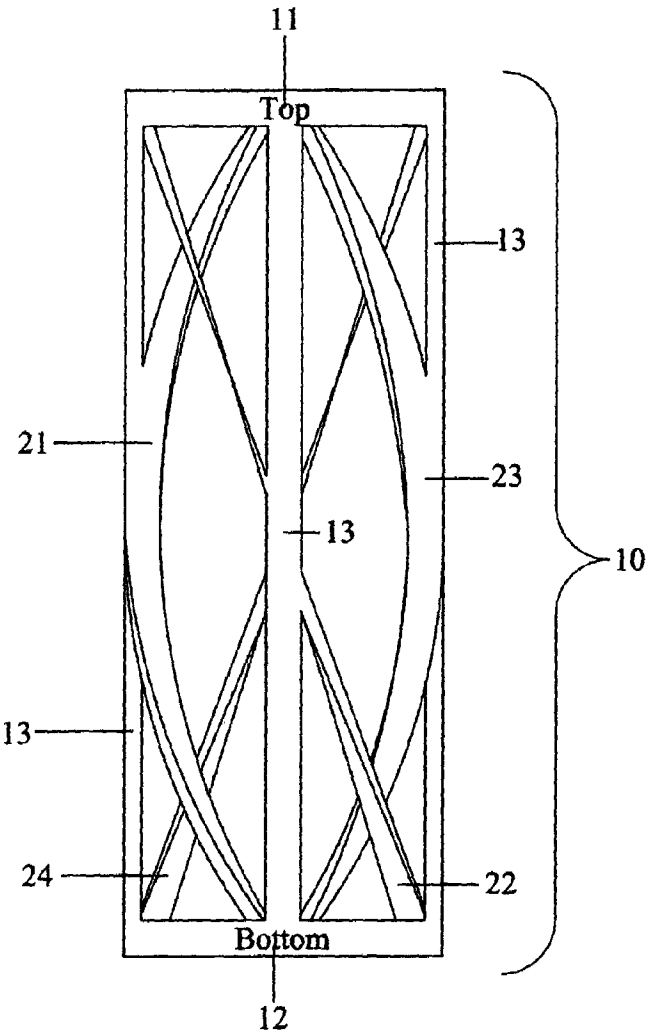
FIG. 2 is a side view of the alternative embodiment of the device.

FIG. 1 is a side isometric view of an alternative embodiment of the device having no sides: this version was used in early testing but is not presently favored. FIG. 2 is a side view of the alternative embodiment of the device. Fixture 10 is generally tubular in outline but lacks a tubular body as such, comprising a lattice work supported by a ring-shaped top end 11 and bottom end 12 connected by support struts 13.

Supported within the cylindrical lattice are four vanes, first vane 21, second vane 22, third vane 23 and fourth vane 24 which curve as they pass from the top end 11 to the bottom end 12, so as to direct the flow of water into a swirled or vortex. These vanes twist helicoidally as they pass down the length of the interior of the device.

Figure 3:
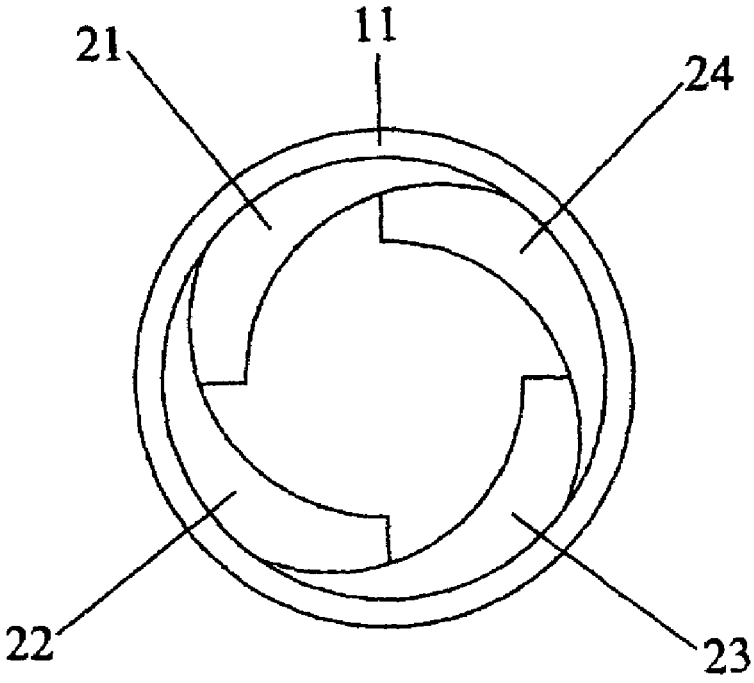
FIG. 3 is a top view of the alternative embodiment of the device.
Figure 4:
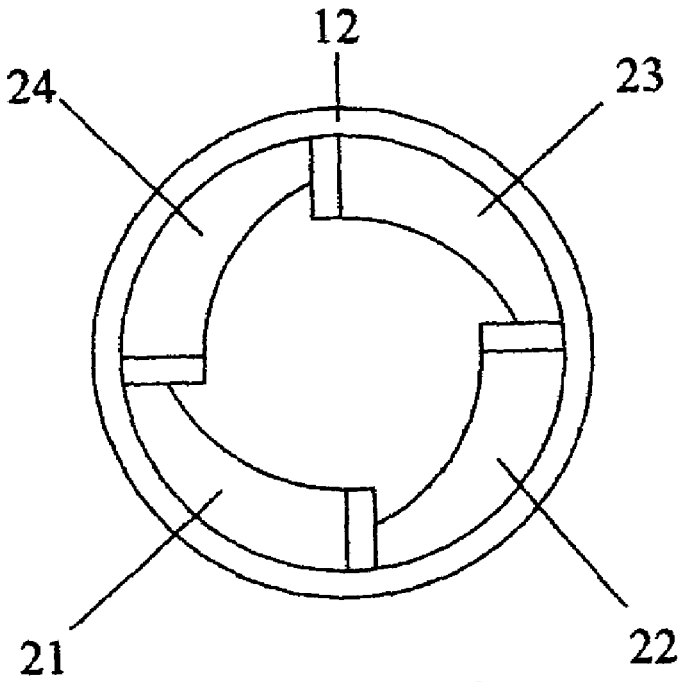
FIG. 4 is a bottom view of the alternative embodiment of the device.

FIG. 3 is a top view of the alternative embodiment of the device, while FIG. 4 is a bottom view of the alternative embodiment of the device. It may be seen that the vanes may be sharp edged at the top end but have bottom surfaces at the bottom end, thus getting wider as they pass down the length of the device.

Figure 5:
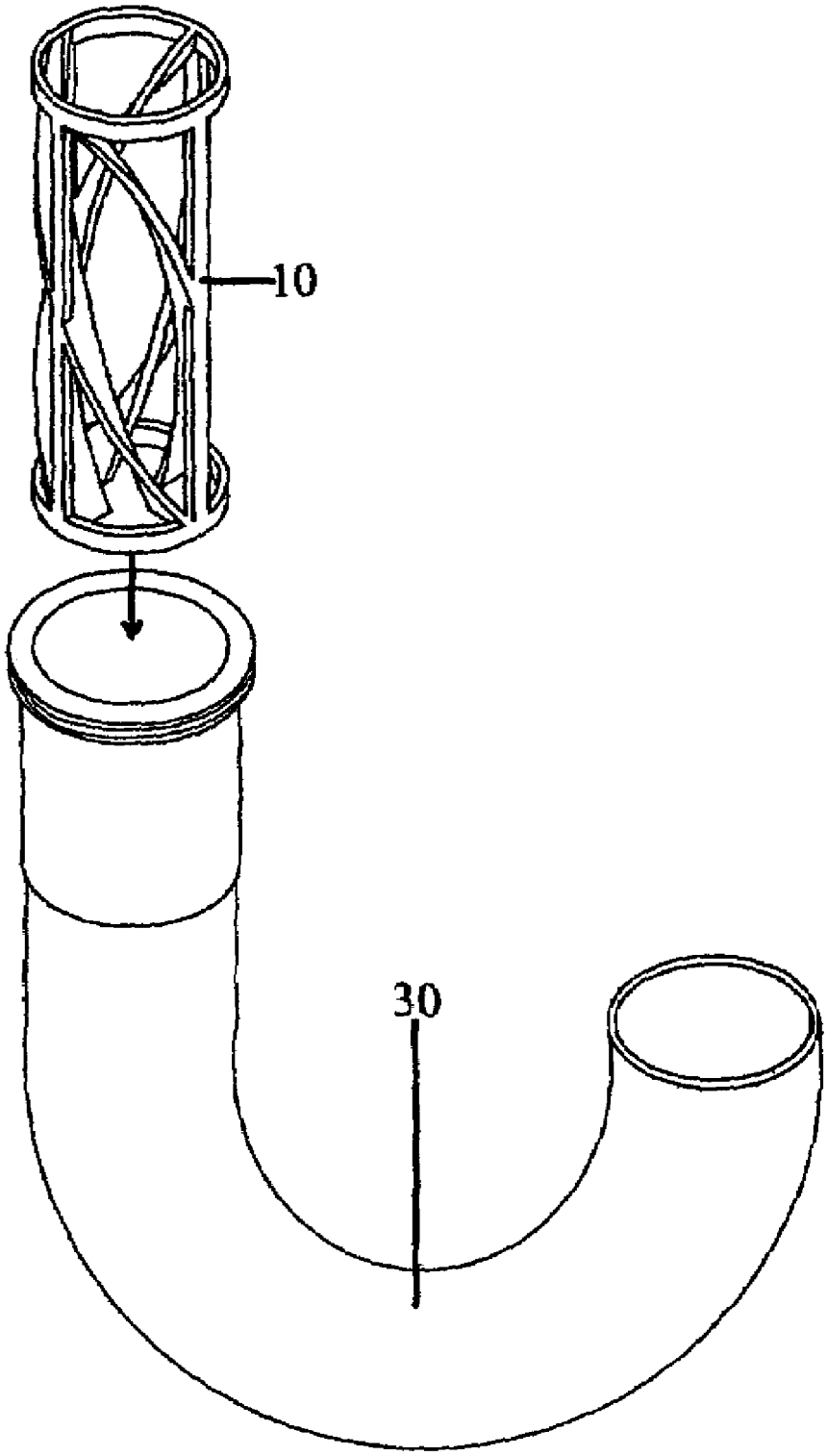
FIG. 5 is an isometric view of the device in use.

FIG. 5 is an isometric view of the device in use. Device 10 fits substantially or wholly within bend 30, and bend 30 is otherwise connected normally to other plumbing fixtures in the plumbing system.

Figure 6:
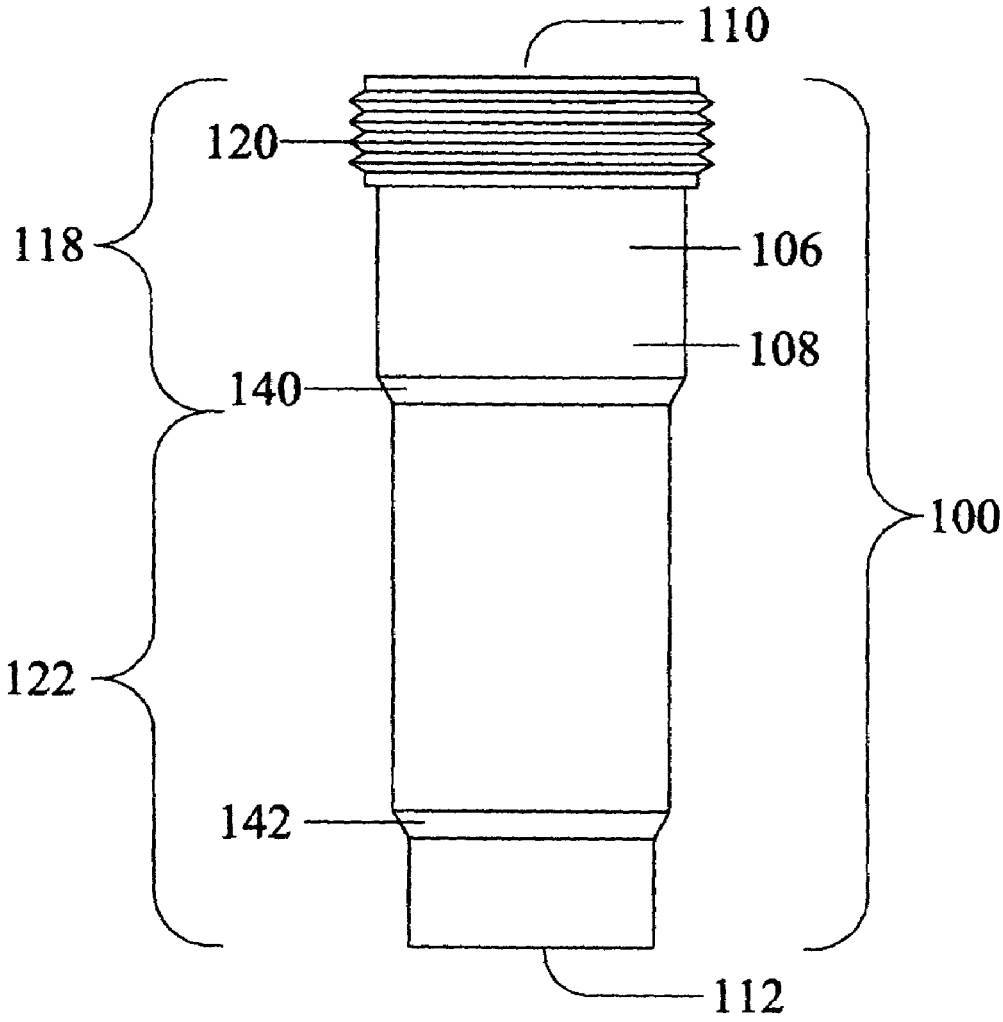
FIG. 6 is a side view of a first embodiment of the device.

FIG. 6 is a side view of a first embodiment of the device. Tubular body 100 has a generally circular cross section shown in later diagrams and is hollow, with a passageway from end to end. Exterior 106 and exterior surface 108 may be divided by steps into several sections between first open end 110 and second open end 112. Coupling section 118 closest to the first open end 110 has thereon the threaded collar 120, which in this diagram is an external thread allowing the device to be fastened on to any standard drain pipe to allow a physical engagement. The coupling may instead be the matching coupling ring or any of a wide variety of other devices. The coupling section 118 may have the same internal diameter as the overall plumbing system outer/exterior diameter, that is, the outer diameter of the U-bend/P-trap, drains, pipes and the like.

Insertion or vestibule section 122 has outer/exterior diameters dimensioned and configured to the diameters of the P-trap, so that insertion section 122 may be inserted into a substantial portion of the P-trap. By this means, at least a portion of the device will be inside of the plumbing system, thus shortening the overall exterior length of the device when installed and allowing better and easier installation.

Reductions in outer diameter of the device may be accomplished by a shrinking of thickness of the cylindrical walls of the tubular body, or by making both interior and exterior diameters smaller. Such reductions may occur in a single gentle angle or in the preferred embodiment presently contemplated may occur at multiple sharper angles. The reductions in size may be accomplished in other ways as well. First step 140 and second step 142 are examples of such reductions, and in the embodiment of FIG. 1, define three different sections of the device.

Figure 7:
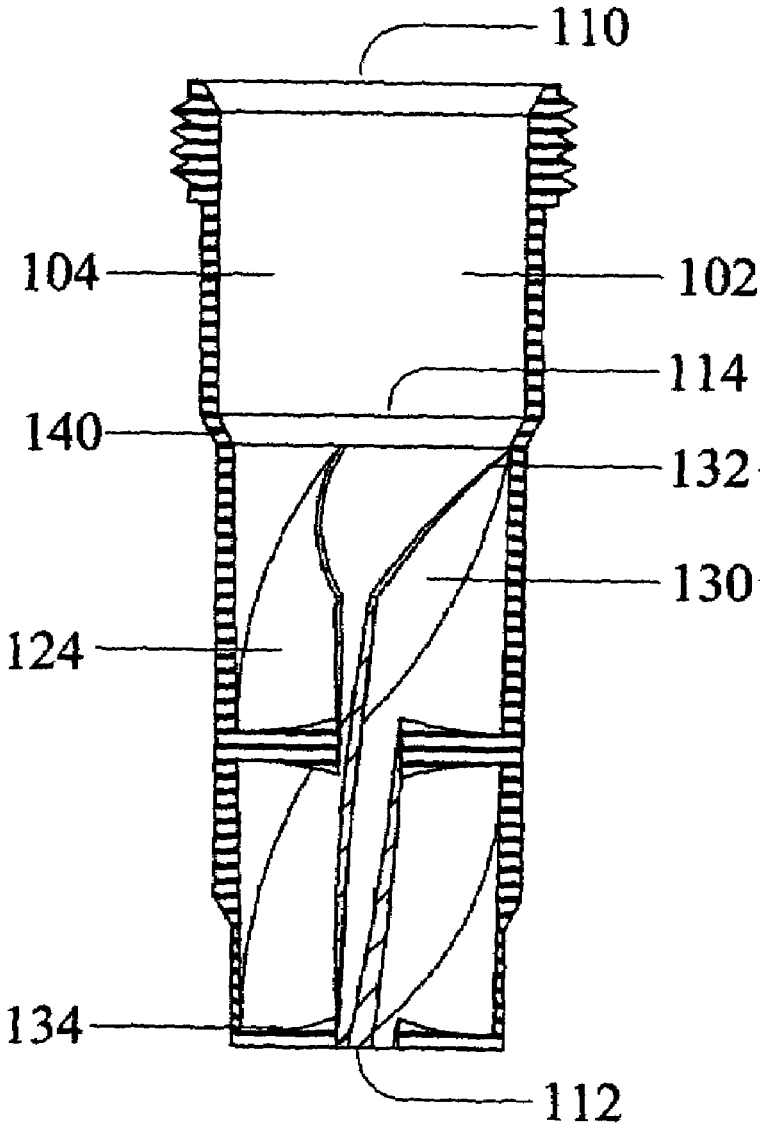
FIG. 7 is a cross-sectional side view of the first embodiment of the device, showing internal features.
Figure 7A:
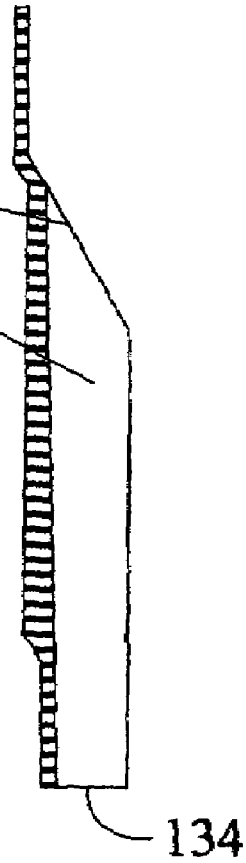
FIG. 7*a* is a partial cross-sectional view rotated in view in order to show one complete vane.
Figure 11:
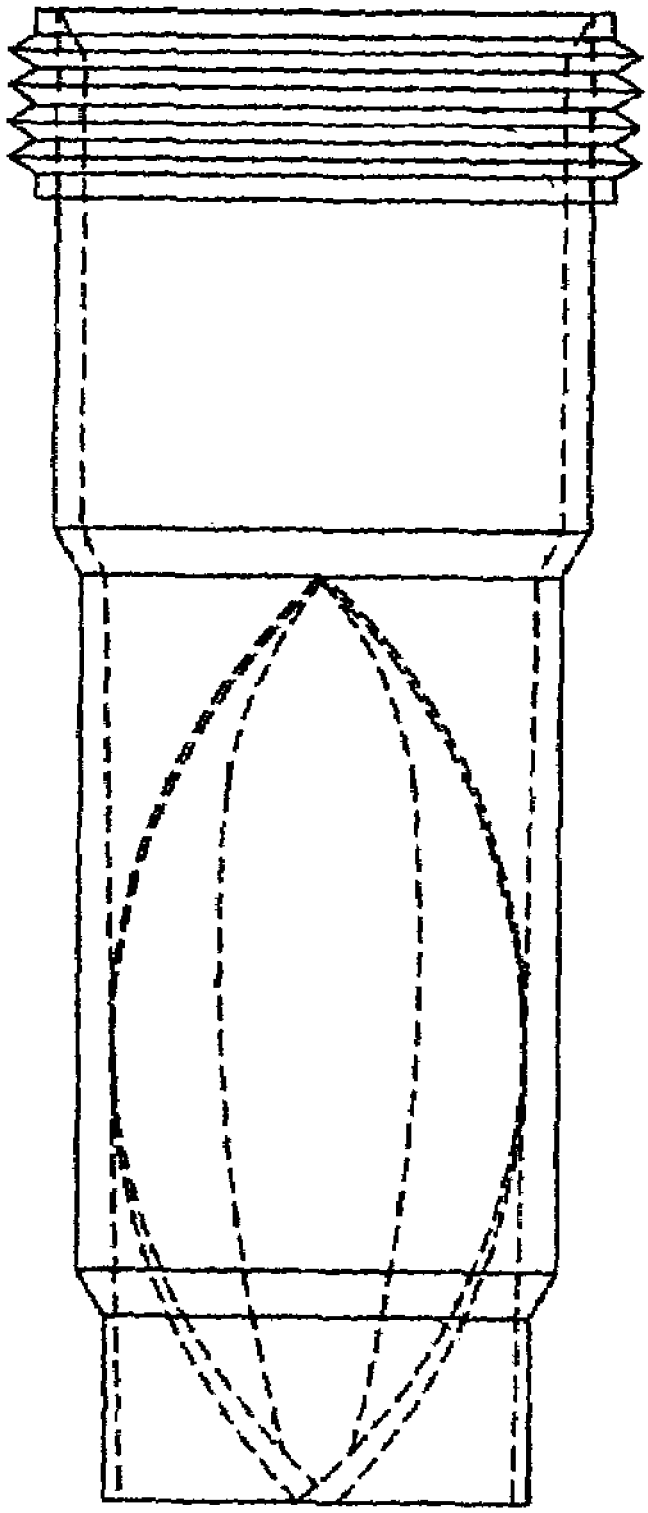
FIG. 11 is a side view of the device transparent so as to show hidden internal features.

FIG. 7 is a cross-sectional side view of the first embodiment of the device, showing internal features, while FIG. 11 is a side view of the device transparent so as to show hidden internal features for additional clarity. FIG. 7*a* is a partial cross-sectional view rotated in view in order to show one complete vane: the vane 130 may be considered to be "straightened" in this view, provided in order to show more clearly a single vane, however, it is important to remember that the vanes are helical as they progress down the interior. These additional views are provided for clarity, as the internal features of the device are a carefully selected and configured. Interior 102 has interior surface 104 on the inner side of the walls of tubular body 100, which defines passage 114 passing from end to end. Passage 114 may in the best mode now contemplated and the presently preferred embodiments be generally cylindrical (having a round cross section) for improved fluid flow therethrough.

First vane 124 and second vane 130 (along with two more vanes shown in FIGS. 2, 3 and 4) may project from the interior surface 104 into passage 114 and thus into the fluid flow through the passage 114. Vane first end 132, the end closer to the first end 110, is the "leading edge" of the vane and may grow gradually from the interior surface 104, projecting further into the passage 114 and fluid flow as it progresses down the passage 114 towards the second end 112, as seen in FIG. 7 and FIG. 7*a*. It may have a straight section lower down. While the topmost point of vane first end 132 is located lower than the first end 110, it may be located at the first end 110 or even may project beyond first end 110, thus requiring insertion into the drain pipe above first end 110 before the coupling 120 may be engaged. First vane end 132 may have a first vane thickness 136, since this is the leading edge of the vane 124 as the fluid flow hits it, this first thickness may be fairly thin. The leading edge of the vane 124 may also have curvature rather than being straight when viewed from above, or it may be straight or of irregular shape.

Vane second end 134 may have a second vane thickness 138 which may be thicker than the first thickness 136. The trailing edge of the vane 124 may also be straight rather than curved as shown in FIG. 7*a*, but it may also be curved or irregular in shape when viewed from below. The trailing edge of the vane 124 may meet the second end 112, may project beyond the second end 112 (thus requiring insertion into the mouth of the P-trap prior to insertion of the second end 112) or may be terminated above end 112.

Figure 8:
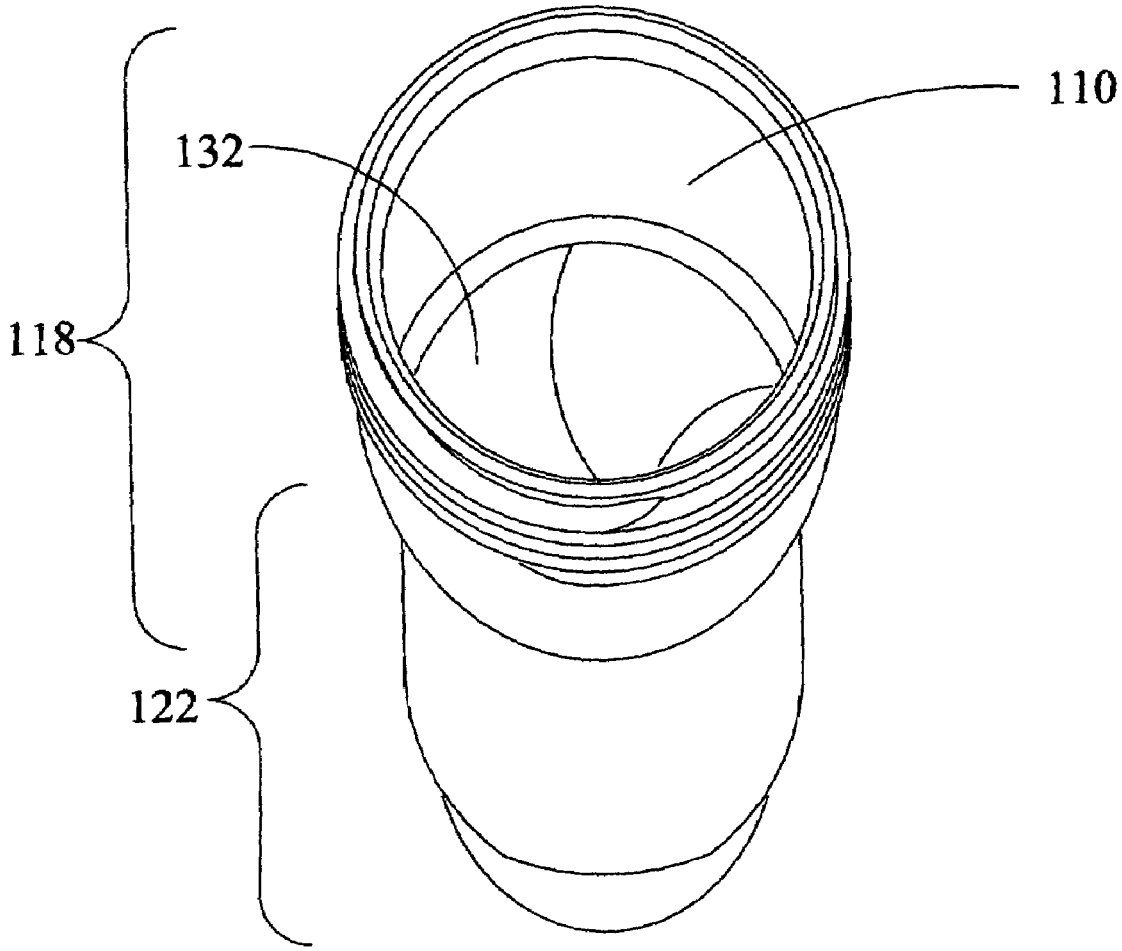
FIG. 8 is an isometric top view of a second embodiment of the device, showing configuration of the vanes at the top end of the vanes, the middle of the device.
Figure 9:
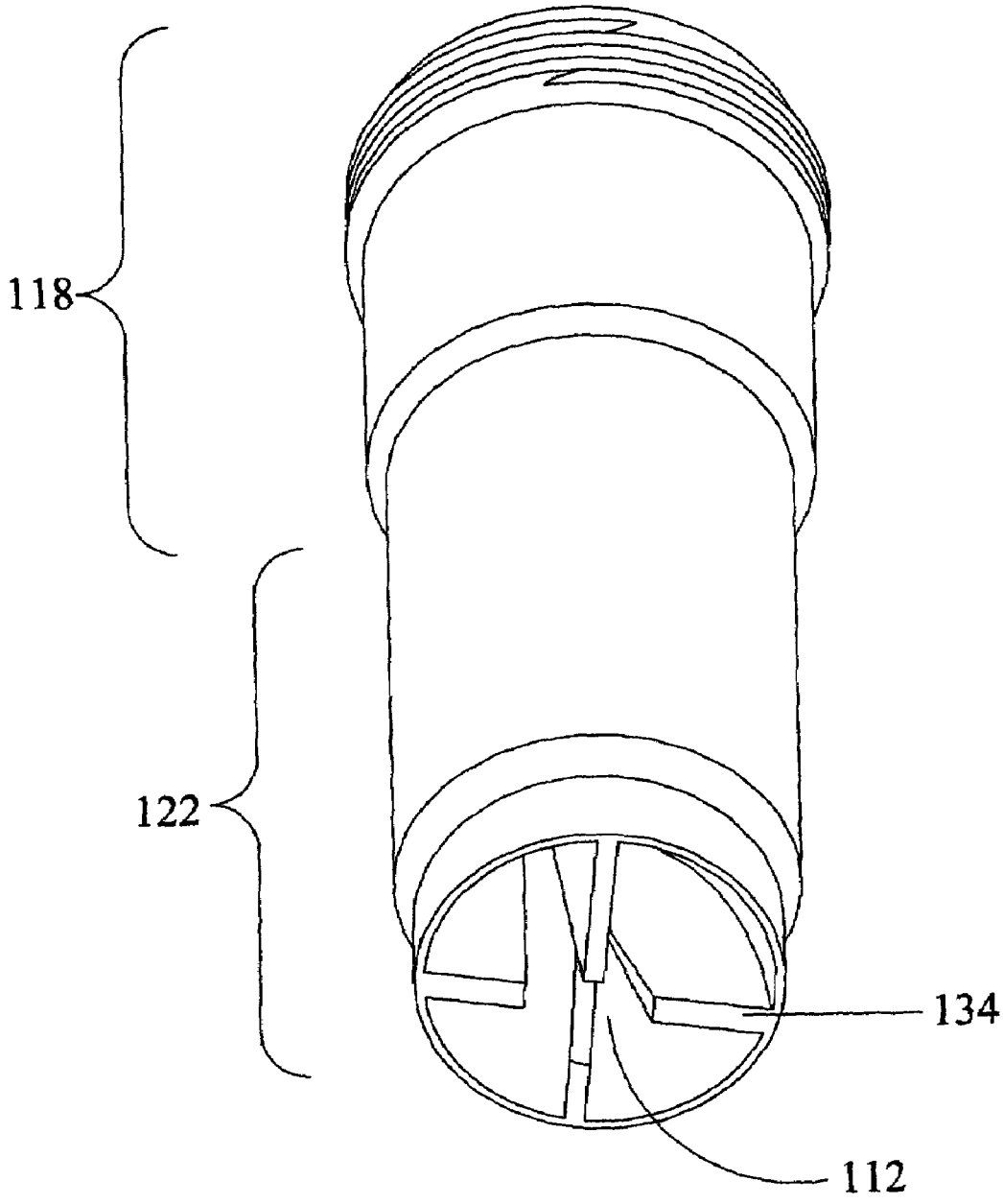
FIG. 9 is an isometric bottom view of the second embodiment of the device, showing configuration of the vanes at the bottom end.

FIG. 8 is an isometric top view of a second embodiment of the device, showing configuration of the vanes at the top end of the vanes, the middle of the device. FIG. 9 is an isometric bottom view of the second embodiment of the device, showing configuration of the vanes at the bottom end. First open end 110 and second open end 112 may be seen (respectively in FIG. 8 and FIG. 9). For clarity, the entire depth of the device is not shown in these views.

Axial support 116 may be used in this embodiment to provide better control of fluid flow or simply to reinforce the vanes 124 and 130. Axial support 116 may be a regular body such as a thin round shape located at the axis of the tubular body 100. Axial support may also assist in manufacturing of the device.

Coupling 120 may be seen in end view, and in this embodiment is also an external threading on the exterior surface of tubular body 100.

First vane 124 and first vane thickness 136 may be compared to second vane thickness 138 and the difference easily seen, as may the difference in shape between the straight trailing edge and the curved leading edge. However, in other alternative embodiments different shapes and thicknesses of vanes may be used.

Figure 10:
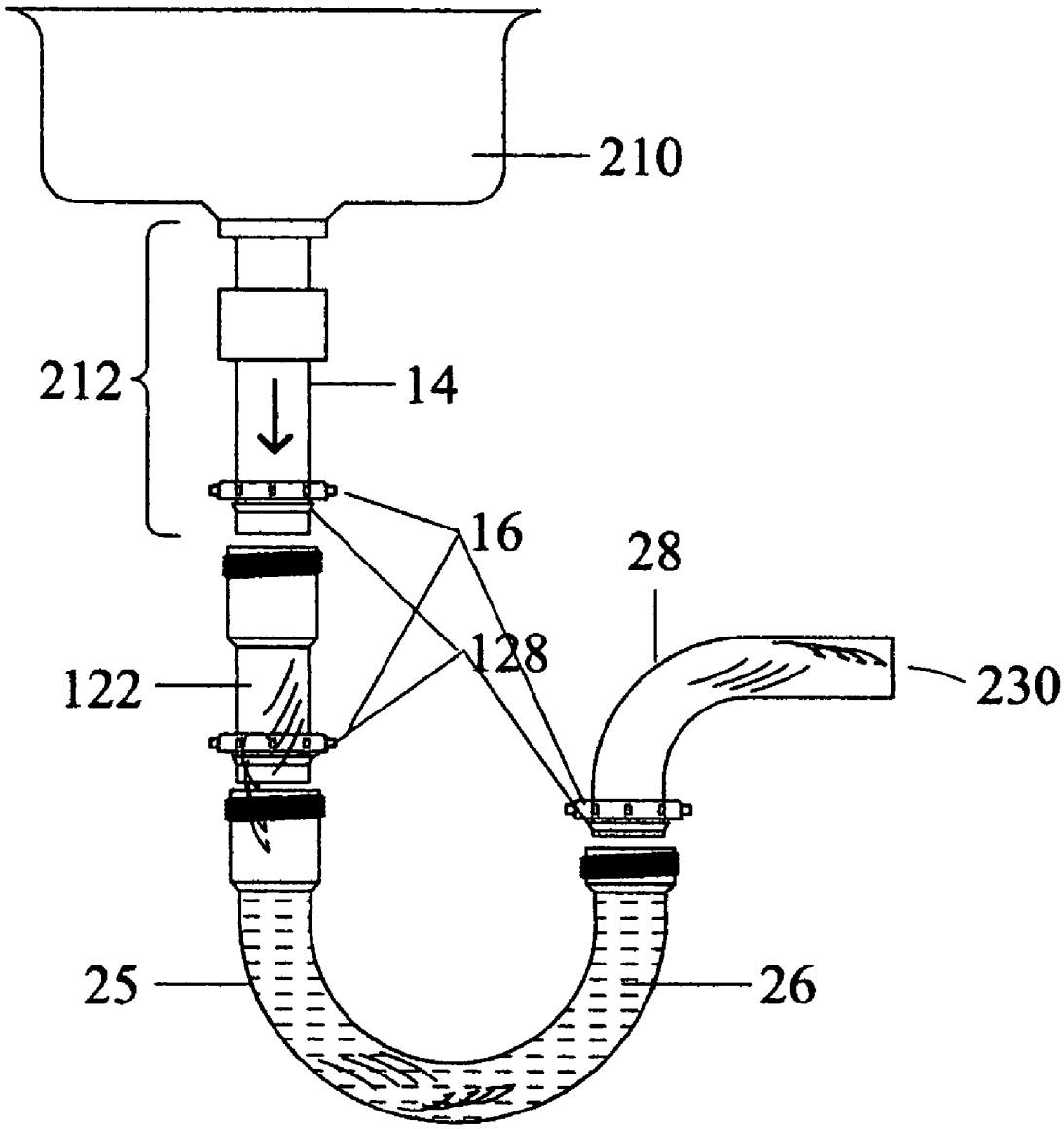
FIG. 10 is a side view of a third embodiment of the device in use in a P-trap drainage system.

FIG. 10 is a side view of a third embodiment of the device in use in a P-trap drainage system. Fixture 210 may be a sink, shower, tub, floor drain, toilet, bidet or any other type of fixture. Drain 212 may be located at the bottom of the fixture 210 so as to easily allow drainage of water or other liquids from the fixture 210 into the sewer or septic system via the plumbing shown.

The vertical pipe may be connected via standard plumbing connectors or other means from fixture 210 to the next item in the plumbing system, which may be U-bend 25 or the invention or another device. Nut 16 may be attached by a gasket or beveled washer 128 to the vertical pipe 14 and so being "trapped" on the plumbing. When mated to an external thread coupling such as that shown or coupling 120 shown previously, the coupling ring 16 may be rotated to bring the two portions of the plumbing system into tight physical engagement.

Plumbing insertion section 122 may be of a size and configuration allowing it to pass into the next part of the plumbing system, allowing a ring coupling trapped on one item to engage an external thread on the other. However, standard plumbing connectors now known or later developed are not so limited.

Plumbing outer/exterior diameter 20 and plumbing inner/interior diameter 22 may be seen on U-bend 25, which is the actual mechanism forming the vapor trap of the invention. Water 26 prevents many vermin and all vapors from passing backwards up the drain from the sewer or septic system to the fixture 10. Elbow 28 connects to substantially horizontal run to outlet 30, completing the portion of the system typically found under a residential sink, although the system is not limited to residential use or sinks.

Nut 16 may be a nut as actually shown in the figures or equivalent, and fits loosely upon a narrower section of tubular body 100 but is trapped thereon by gasket/washer 128, but remains free to rotate so as to engage another device.

Installation of the device may be accomplished as follows. A section of the vertical run 14 may be removed or shortened so as to make distance for the device of the invention to be put into the system, however, since a short portion of the device (which may be longer or the entire length of the device in alternative embodiments) may project into the U-bend below or the vertical pipe above, the distance required is not excessive.

The device may then be inserted into the plumbing device below it, with any vanes which project beyond the bottom end (in alternative embodiments) inserted, then the bottom end inserted into the lower plumbing device. The top end may accept any device from above which may require insertion, and then ring couplers at either end may be tightened to provide physical engagement to the device above and below.

The device may be installed by means other than physical engagement. Any melt welding substances or adhesives may be used, as may sealing materials of any type.

The disclosure is provided to allow practice of the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

What is claimed is:

1. A plumbing device for use in a plumbing system having standard plumbing couplers and having plumbing pipes having a plumbing outer diameter and a plumbing inner diameter, the plumbing device comprising:

a tubular body having an interior, an interior surface, an exterior and an exterior surface, and having a first open end and a second open end connected by the passage, and having an axis;

the tubular body having a coupling section having a standard plumbing coupling thereon, the coupling section having an inner diameter approximately equal to such plumbing outer diameter;

the tubular body having a vestibule insertion section having an outer diameter approximately equal to such plumbing inner diameter, whereby the tubular body insertion section can be at least partially inserted into such plumbing pipes; and at least one vane in the interior of the tubular body, the vane set at an angle to the axis of the plumbing device, the vane having a vane first end, a vane second end, and a vane thickness, the vane thickness varying from the vane first end to the vane second end;

whereby water passing through the plumbing device is urged to rotate as it passes down the length of the interior of the plumbing device.

2. The plumbing device of claim 1, wherein the standard plumbing coupling further comprises:

external threads located about the exterior of the tubular body at one of the two ends.

3. The plumbing device of claim 1, further comprising:

a second coupler disposed at the insertion section of the device.

4. The plumbing device of claim 1, further comprising:

at least a second vane in the interior of the tubular body, the vane set at an angle to the axis of the plumbing device.

5. The plumbing device of claim 1, wherein the variation of the vane thickness from the vane first end to the vane second end further comprises:

gradually increasing thickness from the vane first end to the vane second end.

6. The plumbing device of claim 1, further comprising:

a vane cross section perpendicular to the axis of the tubular body, the vane cross section varying from the vane first end to the vane second end.

7. The plumbing device of claim 6, wherein the variation in the vane cross section from the vane first end to the vane second end further comprises: curved cross section at the vane first end and a straight cross section at a the vane second a end.

8. The plumbing device of claim 1, further comprising:

a molded unibody construction of polymer material.

9. The plumbing device of claim 1, wherein the tubular body further comprises:

a polymer pipe.

10. The plumbing device of claim 1, wherein the tubular body further comprises:

a metal pipe.

11. The plumbing device of claim 1, wherein the coupling section inner diameter further comprises:

a diameter approximately equal to the outer diameter of a standard plumbing drain pipe.

12. The plumbing device of claim 1, wherein the insertion section outer diameter further comprises:

a diameter approximately equal to the outer diameter of a standard plumbing drain pipe.

* * * * *